US005413435A

United States Patent [19]

Batlle

[11] Patent Number: 5,413,435

[45] Date of Patent: May 9, 1995

[54] PREFABRICATED PANEL FOR THE CONSTRUCTION OF DIRECTED FRAGILITY WALLS

[76] Inventor: Juan B. Batlle, Vinya del Rei 3, 08328-Alella (Barcelona), Spain

[21] Appl. No.: 122,174

[22] PCT Filed: Dec. 19, 1990

[86] PCT No.: PCT/ES90/00044

§ 371 Date: Aug. 19, 1991

§ 102(e) Date: Aug. 19, 1991

[87] PCT Pub. No.: WO91/09187

PCT Pub. Date: Jun. 27, 1991

Related U.S. Application Data

[63] Continuation of Ser. No. 752,445, Aug. 19, 1991, abandoned.

[30] Foreign Application Priority Data

Nov. 16, 1990 [ES] Spain ..... 8904269

[51] Int. Cl.[6] ..... E02D 29/02

[52] U.S. Cl. ..... 405/284; 52/98; 52/605; 52/1

[58] Field of Search ..... 52/1, 98, 232, 309.9, 52/578, 586, 605, 607; 405/284, 286, 264

[56] References Cited

U.S. PATENT DOCUMENTS

| | | | |
|---|---|---|---|
| 4,094,108 | 6/1978 | Scott | 52/1 |
| 4,176,503 | 12/1979 | Ting | 52/98 X |
| 4,229,916 | 10/1980 | White | 52/98 |
| 4,400,918 | 8/1983 | Lewis | 52/98 |

FOREIGN PATENT DOCUMENTS

| | | | |
|---|---|---|---|
| 2750827 | 5/1979 | Germany | 52/98 |
| 220791 | 11/1967 | Sweden | 52/98 |

*Primary Examiner*—Carl D. Friedman
*Assistant Examiner*—Kien Nguyen
*Attorney, Agent, or Firm*—Staas & Halsey

[57] ABSTRACT

A fragility earth retainment wall includes a plurality of prefabricated panels. Each panel is bound by at least one complementary resistent member of the wall and has at least one hollowed out portion with an opening on the front seen face of the panel, formed by a groove or a series of holes; each hollowed out portion extends between two edges of the panel and defines therein a preferred fracture line. Thus there are formed modules between at least one hollowed out portion and at least one edge and each module is provided with association members for independent attachment to the complementary resistent member. The panels provide a flexible wall with a good flat arrangement, ease of assembly and good tightness.

22 Claims, 5 Drawing Sheets

PREFABRICATED PANEL FOR THE CONSTRUCTION OF DIRECTED FRAGILITY WALLS

This application is a continuation of application Ser. No. 07/752,445, filed Aug. 19, 1991, now abandoned.

BACKGROUND OF THE INVENTION

1. Field of the Invention

The invention relates to a prefabricated panel for the construction of directed fragility walls, attached to at least one resistent member complementary to the wall, each panel comprising a front seen face, a rear face, end edges separated lengthwise and side edges separated crosswise.

2. Description of Related Art

The presently known prefabricated walls may be considered to be included in one or the other of the two large groups referred to hereinbelow.

A first of these groups relates to constructions with whole piece members which attain the complete height of the wall. They are normally very rigid elements, having a flat surface corresponding to the face of the wall and one or several ribs or buttresses on the rear surface or exterior providing the element with inertia and strength.

This first type of wall requires to be well adjusted to the type of ground where it is constructed, by the design of strict and, frequently expensive, foundations. Manufacture is also costly and requires elements of a very wide range of dimensions for adaptation to the project in each case. Consequently, the stocks are expensive, since they are normally large sized elements.

A second type of wall is formed by elements of small dimensions relative to the height of the wall. These elements are installed in situ using processes which are usually costly in time and money. The purpose of the final result in some cases is a rigid wall like in the first type mentioned above, whereby the assembly operations are complicated and compromising.

The purpose in other cases is to have a flexible wall capable of adapting itself to the movement of the earth; it should be explained that the word earth is used in a very general sense, i.e. the mass of soil, irrespective of whether the orientation of the outer surface thereof is horizontal, vertical or sloping. In these last named cases, against the advantage of an easier foundation solution, there is a lower quality in the outside finish of the wall faces, due to the inevitable errors, frequently compounded, which occur in the drawn out assembly work. It should be pointed out, furthermore, that the treatment of the joints is an important aspect, in view of the large number thereof.

SUMMARY OF THE INVENTION

It is an objective of the invention to provide means for the construction of walls, so that the advantages of the above two types are retained while avoiding at the same time the respective drawbacks.

This purpose is attained according to the invention by panels of the type described above and each panel is characterized in that it is provided with at least one hollowed out portion opening onto said front seen face and formed by a groove or by a series of holes, such that the hollowed out portion extends generally between two edges defining a preferred fracture line, modules being determined between at least one hollowed out portion and at least one edge, each module being provided with association means for independent attachment to said complementary resistent member of the wall.

The said hollowed out portions are easily mistaken for the true joints between contiguous panels and help to form the limits of the modules which are repeated along the whole surface of the wall, suggesting the structural arrangement of the surface and participating in the aesthetic design thereof.

The fundamental purpose of these hollowed out portions, particularly when they are grooves, as stated above, is to provide preferred fracture lines due to the narrowing of the affected sections, such that against serious deformation of the ensemble and against the corresponding appearance of excessive demands in certain sections, there is a local deformation response of the affected area, this response being materialized and made possible by fracture of the weakened sections of the bottom of the prefabricated grooves. These breakages or fractures do not affect the integrity, strength and function of the wall as a whole, since it has already been provided in the design and calculation that each module capable of becoming separated from the contiguous ones, is provided with the necessary retaining means to the complementary resistent member used.

With the panels of the invention, there is made available a flexible wall (an advantage of the second type referred to above) with a good flat arrangement and quality of assembly (advantage of the first type); it is also more watertight than the second type, since there are less true joints, since only the strictly necessary ones are opened and these do not require any treatment, since they are simple millimetric fractures.

Assembly is cheaper, as in the first type, due to the capacity to install fairly large areas, i.e. which include several modules in a single piece, which also affects the speed of installation. Nevertheless, owing to the existence of the modules, it is possible to complete wall heights by simply adding pieces of one or several modules and, therefore, as in the above mentioned second type, the size of stock may be reduced.

Furthermore, the invention allows for the incorporation of an important aesthetic component, since it allows a large variety of creative forms to be used.

BRIEF DESCRIPTION OF THE DRAWINGS

Further advantages and features of the invention will be appreciated from the following description in which, without any limiting nature, there are disclosed preferred embodiments of the invention, with mention of the accompanying drawings. The drawings show.

DETAILED DESCRIPTION OF PREFERRED EMBODIMENTS

Figure 1:
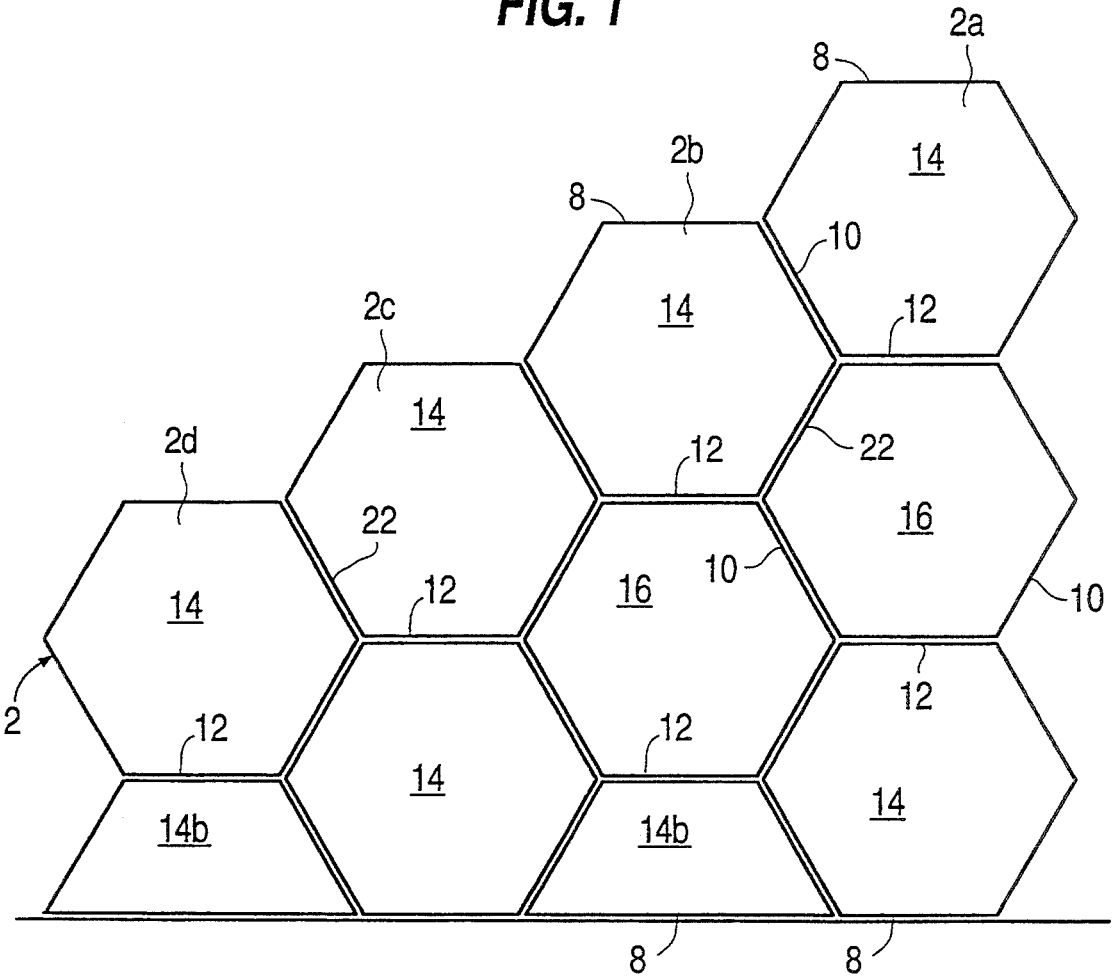
FIG. 1, a front view of a directed fragility wall, comprising panels of the invention.
Figure 3:
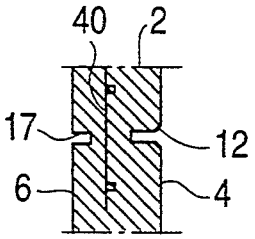
Figure 4:
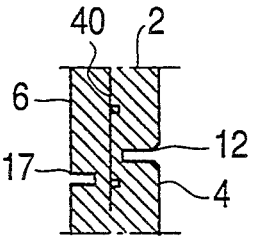

FIG. 1, as stated above, shows part of a wall, formed by prefabricated panels 2, individualized in this case by the reference numerals *2a, 2b, 2c* and *2d*. Said panels are shown in vertical position and comprise a front seen face 4, a rear face 6 (FIGS. 2 to 4), end edges 8 (marked in panel *2a* and between which the panel extends longitudinally) and side edges 10 spaced apart in the transverse direction of the panel.

Each panel 2 comprises at least one hollowed out portion with an aperture 11 (FIGS. 2 and 30) on the front seen face 4. The hollowed out portion preferably consists of a groove 12 extending generally between the side edges 10 of the panel. The smaller section defined by the presence of the grooves 12 causes them to define a preferred line of fracture, i.e., a line along which the panel 2 would preferentially be broken in the case of being subjected to heavy demands.

Figure 22:
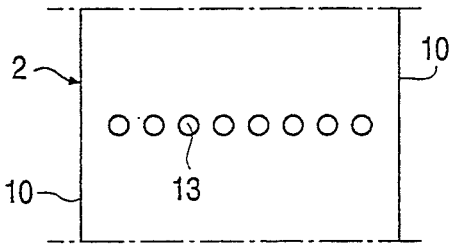
FIG. 22, a partial schematic front view of a panel in which the hollowed out portion is formed by a series of holes.
Figure 23:
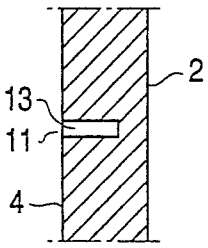
FIGS. 23 and 24, partial sections of the panels along planes through a hole.
Figure 24:
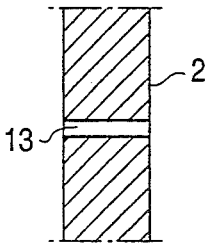

The said hollowed out portion may also be formed by a series of holes 13 (FIGS. 22 to 24) with an opening 11 at least on the front seen face. These holes may be blind (FIG. 23) or through holes (FIG. 24). In all cases they also produce a smaller section of the panel 2 and, as stated below, with regard to the grooves 12, each series of holes 13 also separates two modules of one same panel 2.

Each groove 12 separates two modules 14, 16 and each module 14, 16 is bounded at least by one groove 12 (or a series of holes 13) and by at least one edge 8, 10. When panel *2a* is examined in particular, it is seen to comprise three like modules, which are aligned and comprise two end modules 14 and an intermediate module 16. The existence of other intermediate modules is also obvious. In panel *2a*, the end modules 14 are bounded by a groove 12, one end edge 8 and two side edges 10. In the embodiment described, each edge 10 is formed by a broken line implying the existence of a plurality of portions. Nevertheless, the different portions of the broken line are not deemed to form different side edges individually. In turn, the intermediate module 16 is bounded by two grooves 12 and two side edges 10.

The panel *2c* presents only two identical end modules 14, between which there is the corresponding groove 12. Nevertheless, the invention also contemplates that a first end module 14 and a second end module **14*b* have different dimensions, so that the second end module 14*b* may be equivalent to a fraction of the first end module 14. It is noted that this dimensional difference is to be found in the respective lengthwise dimensions, i.e., the distance between the groove 12 and the end edge 8 of the module 14 is greater (about twice in the proposed example) than the distance between the groove 12 and the end edge in the second end module 14*b***. These cases of unequal dimensions are to be seen in panels *2b* and *2d*, one of them with an intermediate module 16 and the other formed only by end modules.

Figure 2:
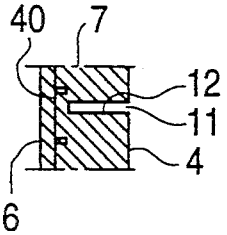
FIGS. 2 to 4, part sections on respective planes transverse to the grooves.

There is at least one groove 12 opening out on the front seen face 4 and thus FIG. 2 illustrates an example of only one groove 12 open on the face 4. Nevertheless, the invention also contemplates that there may be simultaneously grooves 12 open on the seen face and grooves 17 open on the rear face. Under certain circumstances (FIG. 3), both grooves 12 and 17 are preferably aligned (i.e. with the mean plane of both being one same plane)) or (FIG. 4) one groove 17 is slightly offset longitudinally relative to the other groove 12, i.e. the respective mean planes of both grooves are different.

Where the hollowed out portion is formed by a series of holes 13, it is preferred that, instead of a further series of holes 13 opening out on to the rear face, there should be only one series of holes 13, some of which are through holes.

FIGS. 5 to 10 show partially and schematically panels having equal modules, without prejudice to the existence of an unequal end module in the lengthwise direction.

Figure 5:
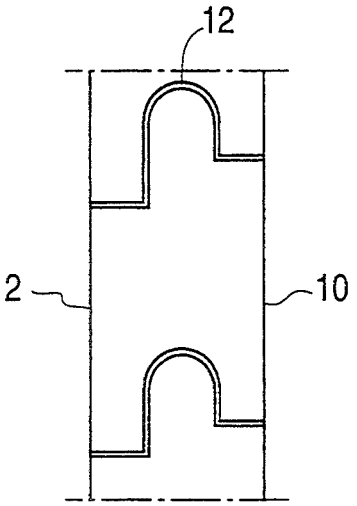
FIGS. 5 to 10, partial schematic front views of different embodiments of a panel of like or equivalent modules.
Figure 7:
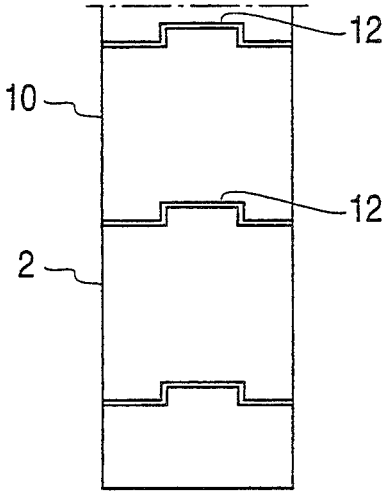

FIGS. 5 and 7 show panels having straight side edges 10 and they are provided with grooves 12 having curved portions (FIG. 5) and/or a broken line shape (FIG. 7). There is obviously no cause-effect relationship between straight edges and grooves which are not straight.

Figure 6:
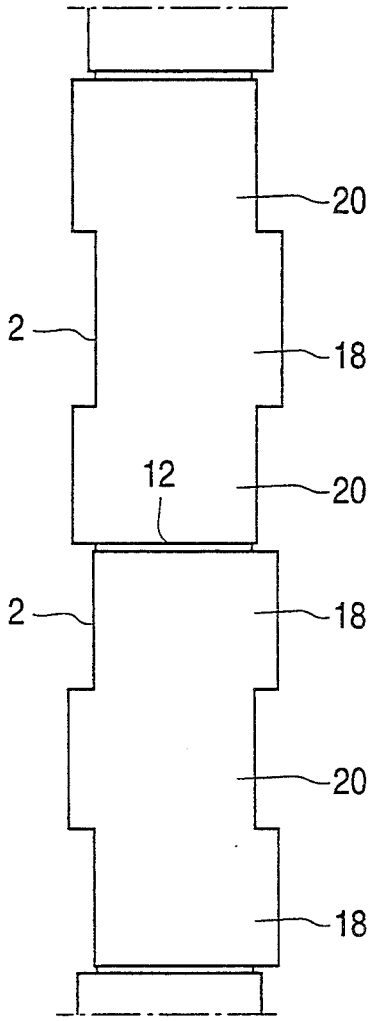
Figure 8:
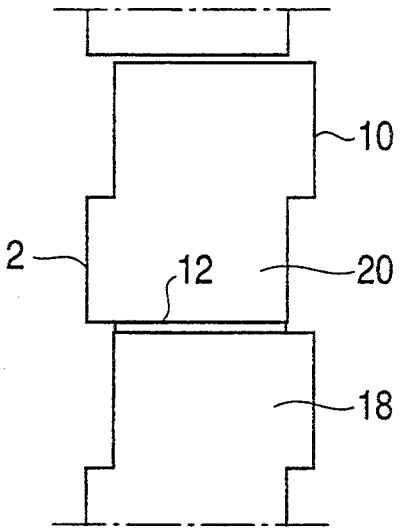
Figure 9:
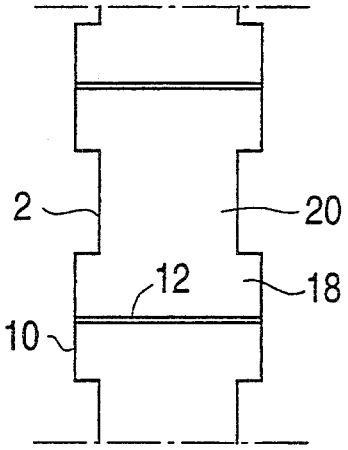
Figure 10:
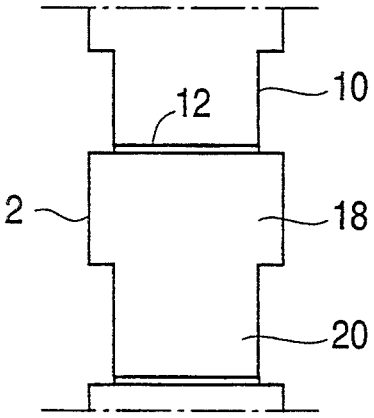

FIGS. 6 and 8 to 10 show panels 2 having broken-line side edges 10, each panel being seen to have laterally salient areas 18 and recessed areas 20, allowing contiguous like panels to engage, such that a recessed area 20 receives a salient area 18 of the contiguous panel. Particularly, FIG. 6 shows a panel in which the contiguous modules 2 are not identical, but equivalent in the sense that one of them has a salient area 18 on the righthand side between two recessed areas 20, while in the other module there is an area 20 between two areas 18 on the righthand side. As may be seen, one module is the reverse of the other. These panels have straight grooves 12, the previous observation excluding a cause-effect relationship also being valid here.

Figure 30:
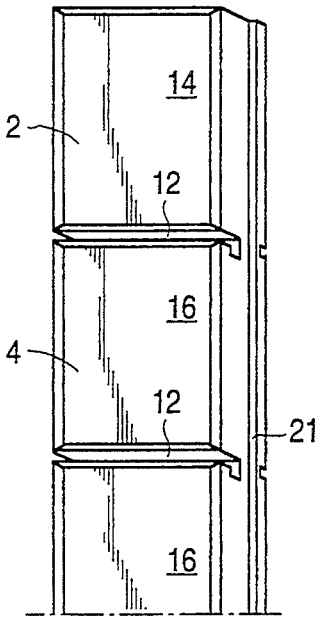
FIG. 30, a partial perspective view of a preferred embodiment of the panel of the invention.
Figure 29:
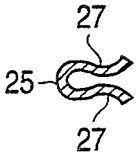
FIG. 29, the shape of a deformable section located outside the grooves.

FIG. 30 shows a panel 2 formed by like, generally rectangular modules 14, 16 separated by grooves 12 open on the front seen face 4 and grooves 17 open on the rear face. This panel has a fin 21 adjacent the rear face.

Figure 11:
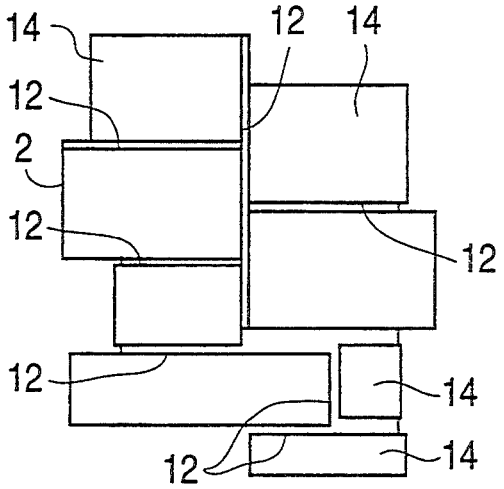
FIG. 11, a front view of a panel with different modules.

In turn, FIG. 11 shows a panel 2, with a variety of modules 14 which are all different from one another and a plurality of grooves 12 of different orientation. This panel would be useful in the case of a particular wall for which certain demands advising such a notably irregular shape were contemplated. It should be understood that it is an object of the invention in particular (although not exclusively) to facilitate the construction of walls by providing panels of substantially constant shapes, such as shown in FIG. 1, where it may be seen that the panels *2b, 2c* and *2d* may also be obtained by segregation of a panel *2a*. It is also pointed out that in the juxtapositioning of panels to form a wall, the grooves 12 substantially blend with the joints 22 between panels.

Figure 25:
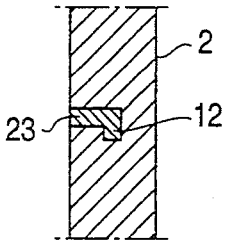
FIGS. 25 and 26, partial sections of panels in which the hollowed out portion is filled with another material.
Figure 26:
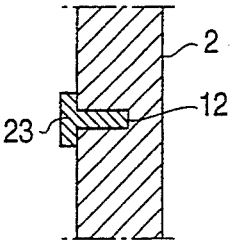

The invention also contemplates (FIGS. 25 and 26) the possibility of at least one of the hollowed out portions, either a groove 12 or a series of holes 13, being filled at least in part with a low deformation or fracture resistent material relative to the resistance of the panel material, and which is differentiated from the panel material, either because it is substantially separated therefrom or because, while being attached thereto, the characteristic differences of the material 23 mean that the affected portion of the panel is clearly weakened and, therefore, more fragile than the rest. Said material (FIG. 23) may cover the opening of the hollowed out portion, either for ornamental purposes, or with the purpose of avoiding the entry of water, soil or others.

Figure 27:
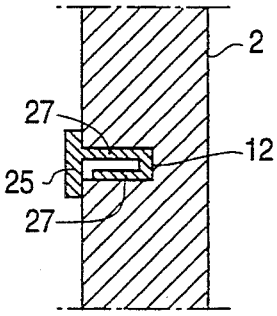
FIGS. 27 and 28, sections similar of panels in which the grooves are filled by deformable sections.
Figure 28:
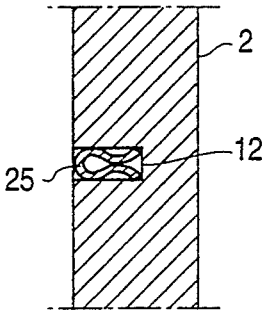

In other cases, (FIGS. 27 and 28), where the hollowed out portion has the form of groove 12, the material inserted is a section 25, which is deformable because of the possibility of the moving together of facing wall portions 27.

As is known, the walls to which reference is made use complementary resistent members such as, for example, ribs, buttresses, anchorages, reinforced earth frameworks, bolts for attachment to soil or rock, etc. Appropriate fixing members are to be found between the corresponding complementary resistent member and the wall.

A further essential feature of the panels of the invention is that each module 14, 14*b*, 16 is provided with association means for independent attachment to the said complementary resistent members. In this way, when a module breaks along the preferred fracture lines, i.e. the grooves 12 or the series of holes 13 and, therefore, the module becomes disassociated from the modules adjacent thereto, the module still has the necessary attachment to the complementary resistent member.

Said association means may be of many types, such as sections or other members, preferably of metal, which are built into the module and have a usable portion or section, i.e. accessible from the outside, where there is a member capable of receiving and retaining the attachment to an external through means.

Figure 12:
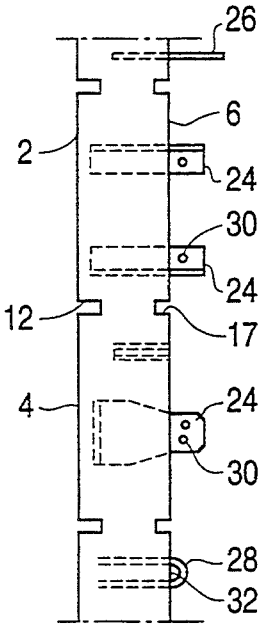
FIGS. 12 and 13, side views of panels according to the invention showing schematically association means for the independent holding of a module to a complementary resistent member of the wall.

In FIG. 12 there are shown examples of such members, as sections 24, straight bars 26 or bent bars 28, in which there are holes 30, loops 32, rings, hooks, grooves and the like in which a filiform member such as a wire or a hook, pin or the like (not shown) may be fastened. The drawing figure illustrates in the same modules a large variety of members, although the usual situation is that the panels of one same set all have the same type of member.

Figure 13:
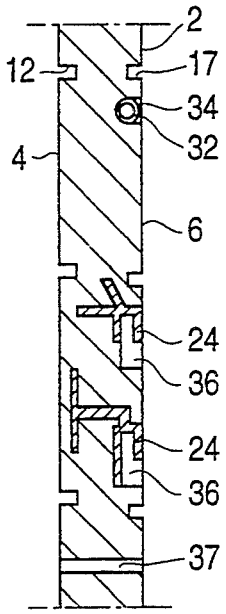
Figure 14:
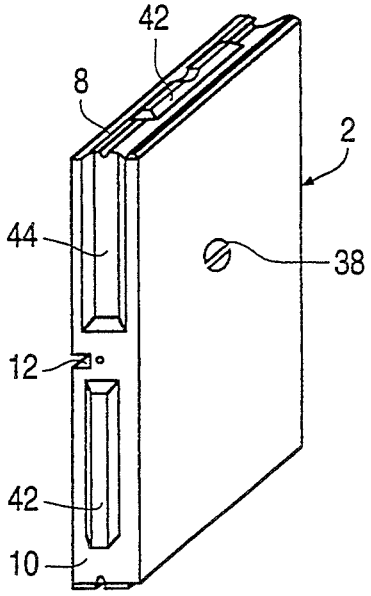
FIG. 14, a perspective view of a panel having irregularities in the edges thereof for the juxtaposed coupling of panels.
Figure 15:
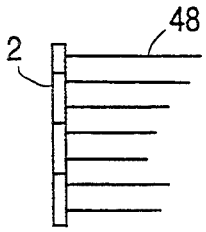
FIGS. 15 to 21, schematic representations of attachment of panels to various complementary resistent members of the wall.
Figure 16:
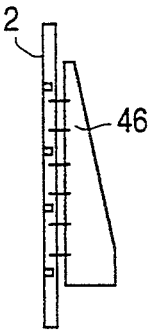
Figure 17:
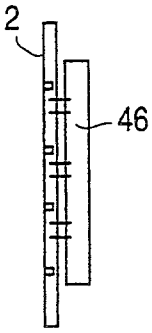
Figure 18:
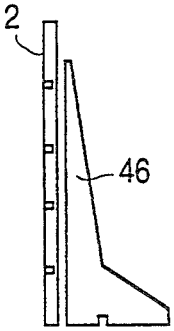
Figure 19:
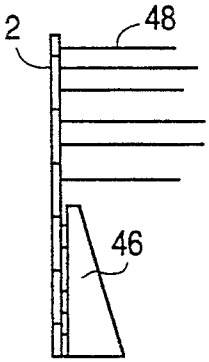
Figure 20:
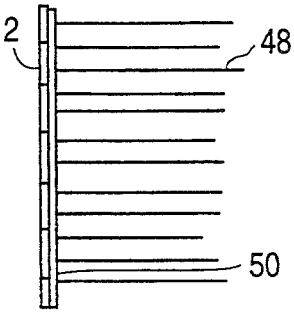
Figure 21:
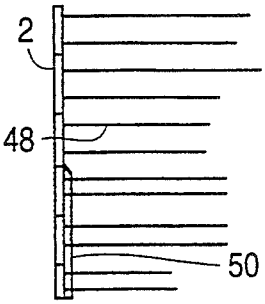

In FIG. 13 there are to be seen preferably steel bars 34 embedded in the module and having a loop 32, a cavity 36 or a through hole 37 having the same utility as described in the paragraph above. FIG. 14 shows a hole 38 formed in the panel and also serving for the utility described.

Independently of the above, it is frequently desirable for the panels 2 to be provided with a frame 40 (FIGS. 2 to 4) reinforcing the sections throttled by the grooves 12, 17, to provide a greater tensile strength without ceasing to be preferred fracture sections. These frames usually extend generally orthogonally to the preferred line of fracture comprised between the modules across two contiguous modules.

The invention also contemplates the existence of irregularities in the edges 8, 10 of the panels 2. These irregularities may be projections 42 or recesses 44 (FIG. 14) which are generally mutually complementary, facilitating the assembly of adjacent panels.

FIGS. 15 to 21 schematically show the attachment of a panel 2 to either buttresses 46 or resistent structures (shown with different shapes), or with reinforced earth frames 48. These attachments may be varied (FIG. 19), with lower modules attached to a buttress and upper modules attached to a reinforced earth frame, The use of ribs 50 also contemplated.

The invention also contemplates the possibility of the wall built with the panels being on appropriate foundations simultaneously with or, as the case may be, in replacement of attachment to the complementary resistent member thereof.

Obviously the panels according to the invention, in at least one module may receive decorative treatments, for example with high, medium or low reliefs or a textural surface treatment or with the incorporation of extraneous elements or differentiating paintings.

The size of the hollowed out portions, particularly when they are formed by grooves, may cause difficulties during the moulding process of the panels according to the invention.

These problems are more probable during the mould stripping phase and to avoid them, prior to complete stripping of the panel, the items forming the hollowed out portions are first removed, using therefor Lever, hydraulic or equivalent devices which move these items completely independently of the rest of the mould.

Where the hollowed out portion is to be filled with a low strength material, the hollowed out portion is formed by the filling material itself, inserted previously to the moulding of the panel. In other cases, said forming may be effected by a lost section (disposable), normally a perishable material removed together with the moulded panel.

In certain cases for handling the panels up to their placement on site, they may be provided with provisional members for reinforcing or externally protecting the fragile areas and which must be removed once their mission terminated, only for the purpose of avoiding or limiting early fracture.

Said members will always be easy and quick to insert and remove, such as for example pieces of metal section or flat bars provided with holes through which bars or hooks embedded in or held at both sides of a preferential fracture line.

What I claim is:

1. A device comprising:

a directed fragility earth retainment wall, adapted for attachment to at least one resistant member complementary to the earth retainment wall, the earth retainment wail comprising a plurality of panels, each panel of the plurality of panels comprising:

a front seen face;

a rear face;

end edges extending lengthwise; and side edges extending crosswise, said panel being provided with at least one hollowed out portion opening onto at least said front seen face and formed by at least one of a groove and a series of holes, such that the hollowed out portion extends generally between two end edges defining a preferred fracture line, said panel being divided into rigid modules being defined by at least one hollowed out portion and at least two side edges, each module being provided with association means for independent attachment to said resistant member complementary to the earth retainment wall and each module having a tensile strength of at least approximately 1 ton per $m^2$.

2. The panel of claim 1, wherein the panel is divided into at least a first end module and a second end module between which there is at least one hollowed out portion.

3. The panel of claim 2, wherein the modules forming the panel are aligned, and the panel is further divided into at least one intermediate module which, together with the first and second end modules, form an alignment.

4. The panel of claim 3, wherein the two end modules and the intermediate modules are of substantially the same size and shape.

5. The panel of claim 3, wherein said first end module and said intermediate modules are of substantially the same size and shape and said second end module is of a size and shape of one portion of the first end module and the intermediate modules.

6. The panel of claim 5, wherein the longitudinal dimension of the first end module is longer than the longitudinal dimension of the second module.

7. The panel of claim 1, wherein the hollowed out portions only have an opening on the front seen face.

8. The panel of claim 1 wherein each of said hollowed out portions opening out onto the front seen face has a complementary hollowed out portion opening out onto the rear face.

9. The panel of claim 8, wherein each groove opening out onto the front seen face is aligned with a complementary groove opening onto the rear face.

10. The panel of claim 8, wherein each groove opening out onto the front seen face is slightly offset longitudinally relative to a complementary groove opening out onto the rear face.

11. The panel of claim 1, wherein at least one hollowed out portion has curved and/or cornered portions such that the preferred fracture line is not straight.

12. The panel of claim 11, wherein said hollowed out portion is a groove and said filler material defines a deformable section.

13. The panel of claim 1, wherein at least one of said hollowed out portions is filled at least partially by a filler material having low resistance to at least one of deformation and fracture relative to that of the rigid module material.

14. The panel of claim 13, wherein said filler material covers said opening of said hollowed out portion onto said front seen face at least partially.

15. The panel of claim 1 comprising a frame means extending across at least two adjacent modules and generally orthogonal to the preferred fracture line between each of said at least two adjacent modules.

16. The panel of claim 1, wherein said association means comprise built in members partially embedded in said panel and provided with a protruding portion having at least one element adapted to receive and retain a through member of the resistance member.

17. The panel of claim 16, wherein said element is at least one of a hole, a ring, a hook, a cavity and a loop.

18. The panel of claim 1, wherein said association means comprises at least one hole in the module.

19. The panel of claim 1, wherein at least one of the side edges thereof have a first irregularity complementary to a complementary irregularity on a side edge of another panel.

20. The panel of claim 1, wherein the series of holes are provided in the front seen face and extend partially through the prefabricated panel.

21. The panel of claim 1, wherein the series of holes are provided in the front seen face and extend through the panel, opening onto the rear face.

22. A device comprising:

a directed fragility earth retainment wall comprising a plurality of prefabricated panels, each prefabricated panel of the plurality of prefabricated panels being divided into a plurality of rigid modules by at least one hollowed out portion defining a generally horizontal preferred fracture line, each module being provided with association means for separately attaching each module to a complementary resistant member, said prefabricated panel having a shape which allows the prefabricated panel to tightly fit together with other prefabricated panels to form the directed fragility earth retention wall and each module having a tensile strength of at least approximately 1 ton per $m^2$.

* * * * *